US006791486B2

(12) United States Patent
Mourry et al.

(10) Patent No.: US 6,791,486 B2
(45) Date of Patent: Sep. 14, 2004

(54) UNFOLDABLE ELECTROMAGNETIC REFLECTOR

(75) Inventors: Philippe Mourry, Ramonville-Saint-Agne (FR); Lionel Garon, Toulouse (FR); Jean-Luc Pinchot, Muret (FR)

(73) Assignee: Etienne Lacroix Tous Artifices S.A., Muret (FR)

( * ) Notice: Subject to any disclaimer, the term of this patent is extended or adjusted under 35 U.S.C. 154(b) by 0 days.

(21) Appl. No.: 10/258,378

(22) PCT Filed: Feb. 21, 2002

(86) PCT No.: PCT/FR02/00648

§ 371 (c)(1),
(2), (4) Date: May 6, 2003

(87) PCT Pub. No.: WO02/069441

PCT Pub. Date: Sep. 6, 2002

(65) Prior Publication Data

US 2003/0164788 A1 Sep. 4, 2003

(30) Foreign Application Priority Data

Feb. 23, 2001 (FR) ..... 01/02483
Feb. 23, 2001 (FR) ..... 01/02484
Feb. 23, 2001 (FR) ..... 01/02485

(51) Int. Cl.[7] ..... H01Q 15/20
(52) U.S. Cl. ..... 342/7; 342/8; 342/10
(58) Field of Search ..... 342/5, 7, 8, 9, 342/10

(56) References Cited

U.S. PATENT DOCUMENTS

| | | | | | |
|---|---|---|---|---|---|
| 2,534,716 | A | * | 12/1950 | Hudspeth et al. | 441/20 |
| 2,576,255 | A | * | 11/1951 | Hudspeth et al. | 342/8 |
| 3,047,860 | A | * | 7/1962 | Swallow et al. | 342/5 |
| 3,296,617 | A | | 1/1967 | Rogallo | |
| 3,618,111 | A | | 11/1971 | Vaughan | |
| 5,451,975 | A | * | 9/1995 | Miller et al. | 343/915 |
| 6,507,307 | B1 | * | 1/2003 | Huber, Jr. | 342/9 |
| 2003/0164788 | A1 | * | 9/2003 | Mourry et al. | 342/7 |

FOREIGN PATENT DOCUMENTS

| | | |
|---|---|---|
| EP | 0807991 | 11/1997 |
| EP | 1052725 | 11/2000 |
| GB | 746300 | 3/1956 |
| GB | 812376 | 4/1959 |
| WO | WO 93/21367 | 10/1993 |

* cited by examiner

*Primary Examiner*—John B. Sotomayor
(74) *Attorney, Agent, or Firm*—Blakely Sokoloff Taylor & Zafman

(57) ABSTRACT

The present invention relates to a device forming an electromagnetic reflector comprising a deployable support frame (100) carrying at least one cloth element (200) designed, in the deployed state, to form a reflective surface, the device being characterized by the fact that the deployable support frame (100) comprises at least one deployable arm (120) that is telescopic.

64 Claims, 9 Drawing Sheets

UNFOLDABLE ELECTROMAGNETIC REFLECTOR

The present patent application is a non-provisional application of International Application No. PCT/FR02/00648, filed Feb. 21, 2002.

The present invention relates to the field of electromagnetic reflectors.

It applies to all potential applications of electromagnetic reflectors, such as, and in non-limiting manner, use as position-identifying beacons, e.g. for moving vehicles.

Numerous means have already been proposed for forming electromagnetic reflectors.

Reference can be made, for example, to the following documents: FR-A-2 723 263, EP 0 182 274, FR 1 226 263, GB 913 547, U.S. Pat. No. 3,217,325, U.S. Pat. No. 3,041,604, U.S. Pat. No. 3,115,631, U.S. Pat. No. 3,568,191, GB 2 188 783, GB 2 189 079, FR 2 073 370, U.S. Pat. No. 4,119,965, U.S. Pat. No. 4,096,479, U.S. Pat. No. 4,072,948, U.S. Pat. No. 3,660,843, and U.S. Pat. No. 3,276,017.

For example, document FR-A-2 723 263 describes devices comprising a deployable support frame carrying a plurality of cloth segments designed to co-operate in the deployed state to form reflective polyhedra.

The present invention seeks to provide novel means providing improved efficiency over the prior art.

In the context of the present invention, these objects are achieved in a first aspect by an electromagnetic reflector comprising a deployable support frame carrying at least one cloth element designed, in the deployed state, to form a reflective surface, the device being characterized by the fact that the deployable support frame comprises at least one deployable arm that is telescopic.

After numerous tests and studies, the Applicant has observed that using such a telescopic deployable arm enables each cloth element to be deployed in perfectly plane manner, leading to reflector performance that is better than that of known prior devices.

According to an advantageous characteristic of the present invention, the deployable support frame carries a plurality of cloth elements designed to co-operate in the deployed state to form reflective polyhedra.

According to another advantageous characteristic of the present invention, the deployable support frame comprises a central core which carries the telescopic deployable arm.

In an advantageous embodiment of the present invention, the device comprises a support frame made up of a central core which carries a main telescopic mast associated with four hinged arms.

In a variant, the support frame may comprise a core carrying six telescopic arms.

According to another advantageous characteristic of the present invention, the device is arranged as an octahedron.

In a second aspect, the above-specified objects are achieved in the context of the present invention by an electromagnetic reflector comprising a support frame which carries at least one cloth element designed to form a reflective surface, the reflector being characterized by the fact that the cloth is formed by a knitted fabric.

The Applicant has observed that such a cloth accommodates a certain amount of elongation suitable for optimizing deployment.

Furthermore, cloth formed of a knitted fabric can be folded so as to lead to very compact storage, without presenting any residual creases after being deployed, and it offers a high degree of flexibility.

According to another advantageous characteristic of the present invention, the support frame has at least one sling for optimizing deployment of the cloth.

According to another advantageous characteristic of the invention, the sling is disposed along an edge of the cloth element.

The device of the present invention also preferably comprises means suitable for orienting or indeed rotating the device once it has been deployed and released into free fall.

Thus, in a third aspect, the above-specified objects are achieved in the context of the present invention by an electromagnetic reflector comprising a support frame carrying a plurality of cloth elements designed to co-operate to form reflecting polyhedra, the reflector being characterized by the fact that it further comprises means for controlling aerodynamic behavior suitable for imparting an orientation to the support frame so that it presents at least one outside edge that is horizontal.

The Applicant has found that this characteristic is important for obtaining a mean response at high level.

According to another advantageous characteristic of the present invention, the horizontal external edge is a bottom edge of the support frame.

According to an advantageous characteristic of the present invention, such means for controlling orientation and rotation comprise at least one support sail.

Other characteristics, objects, and advantages of the present invention appear on reading the following detailed description and from the accompanying drawings, given by way of non-limiting example, and in which.

Figure 4:
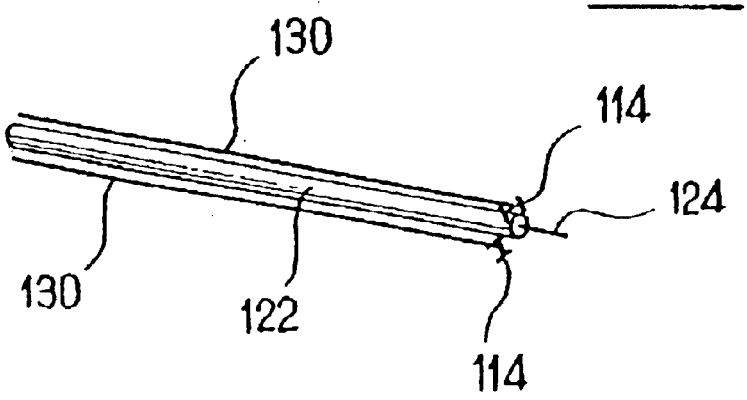
Figure 5:
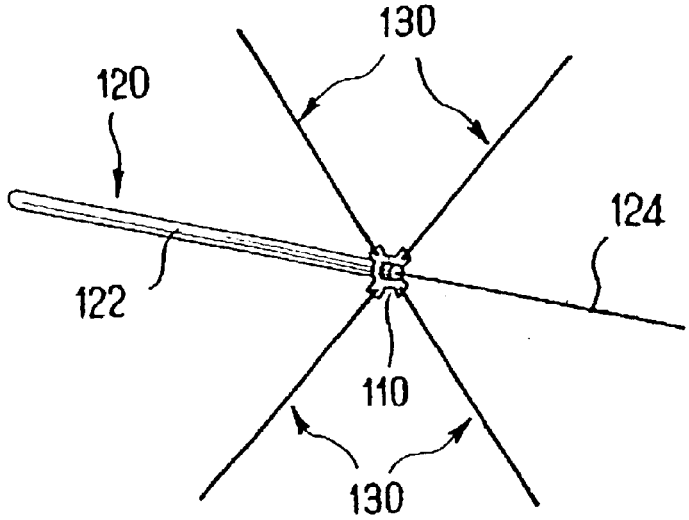
Figure 6:
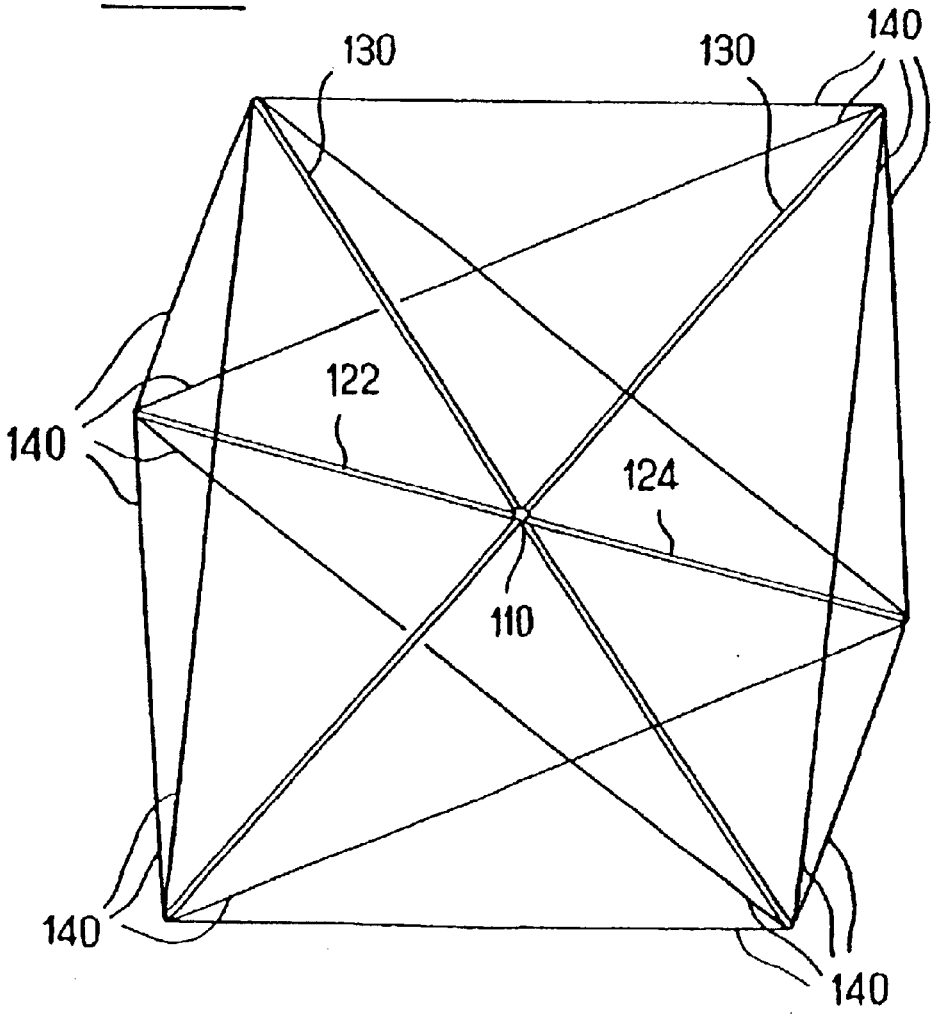
Figure 7:
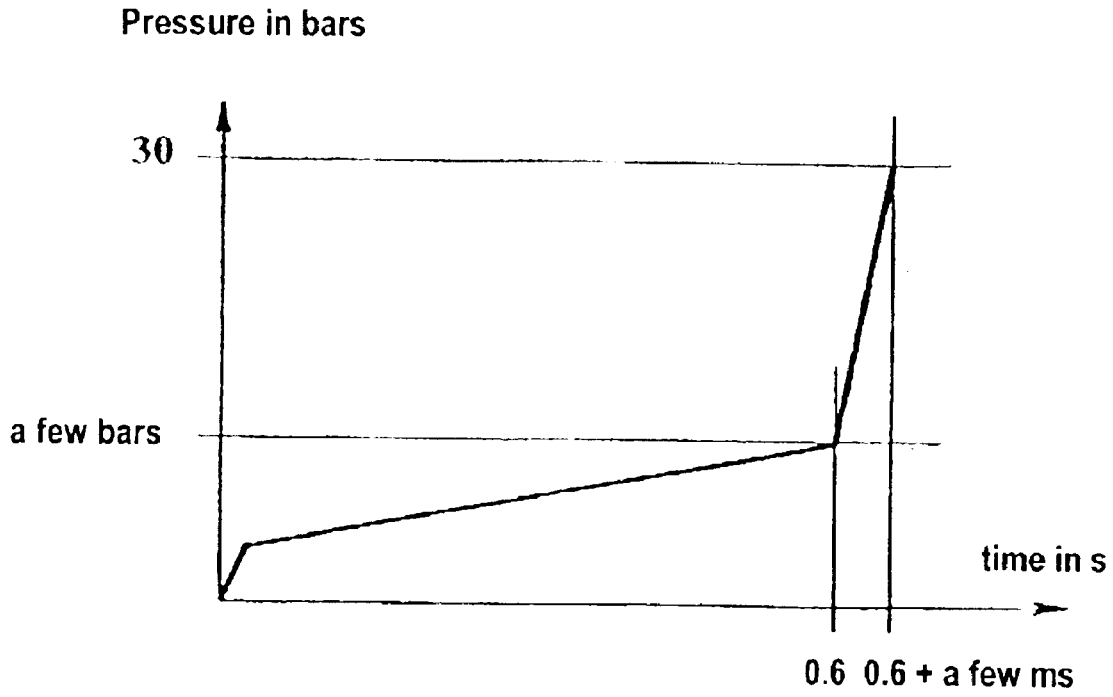
Figure 8:
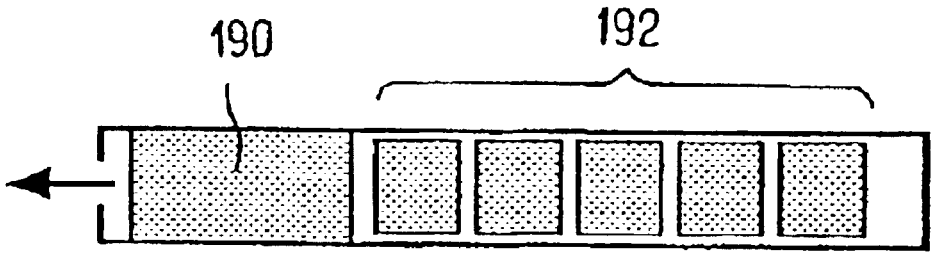
Figure 9:
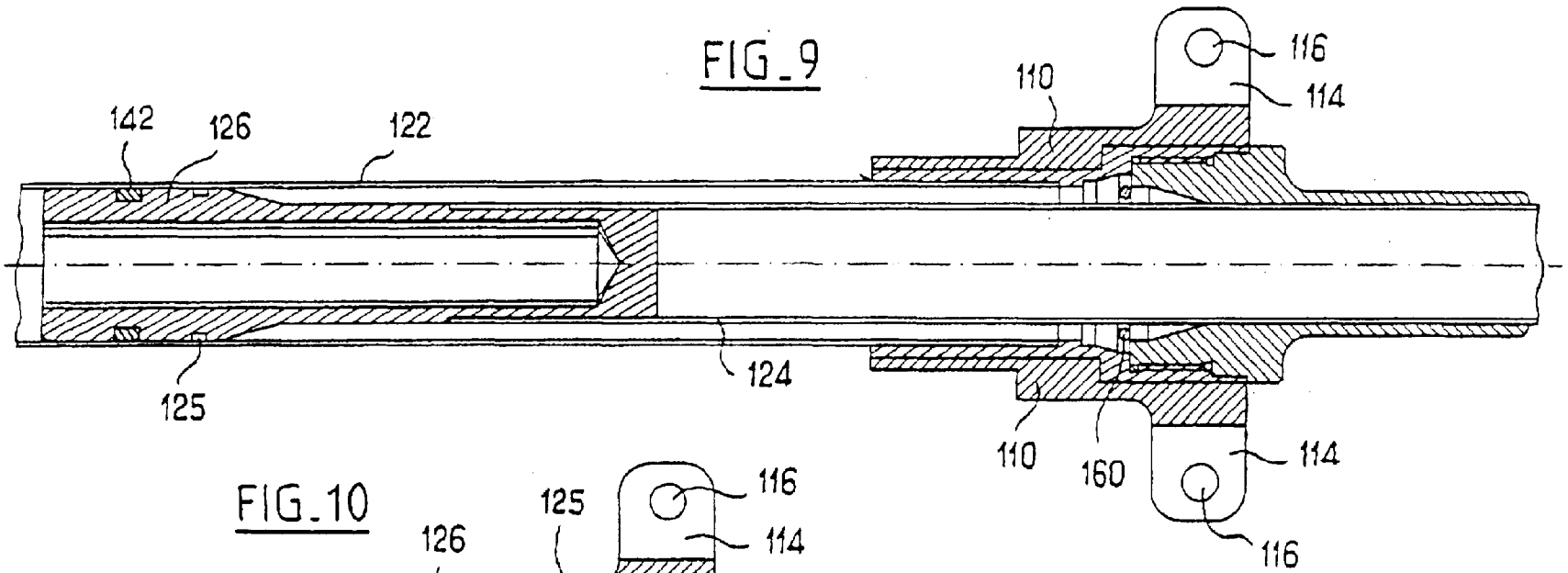
Figure 10:
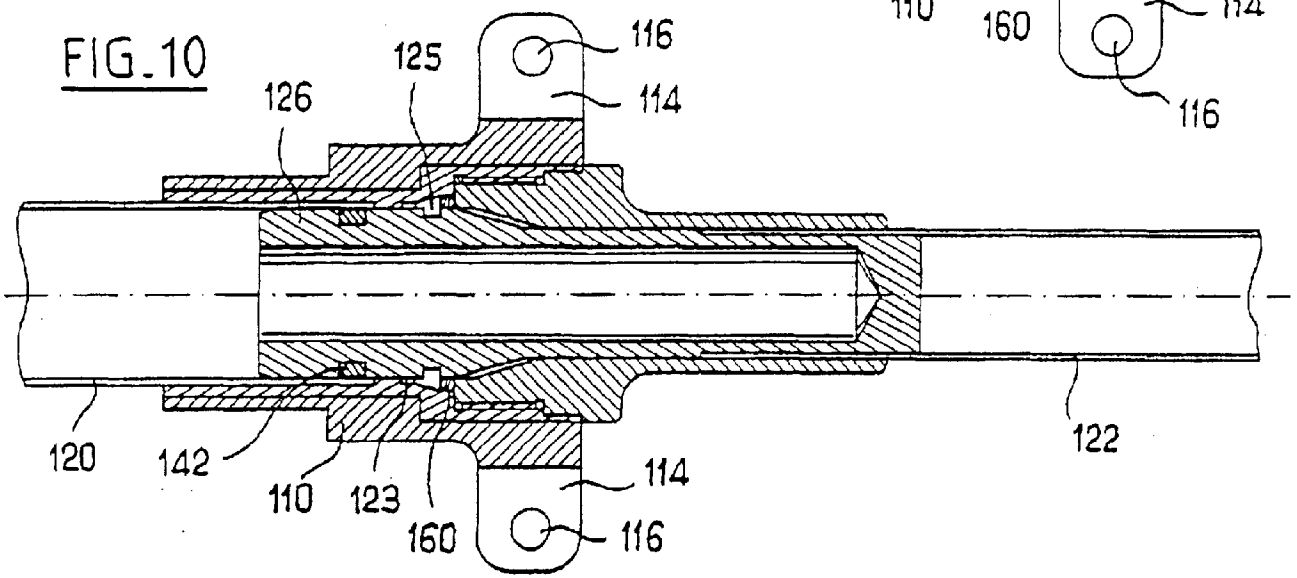
Figure 13:
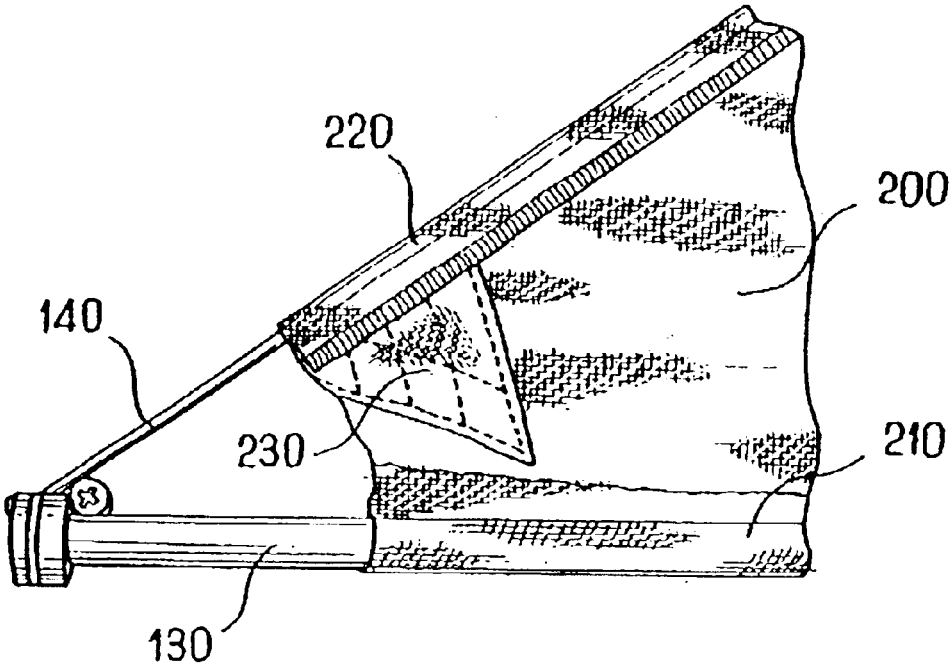
Figure 14:
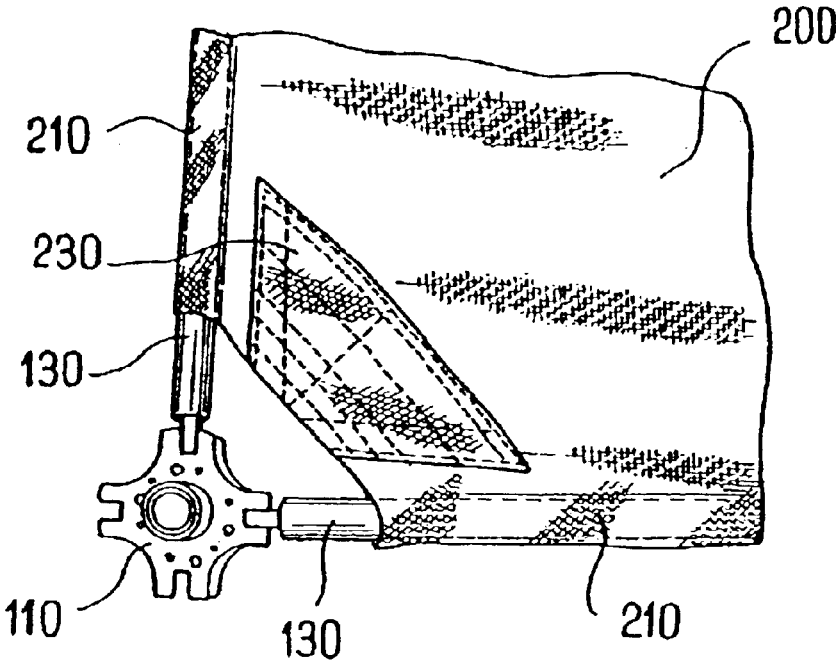
Figure 15:
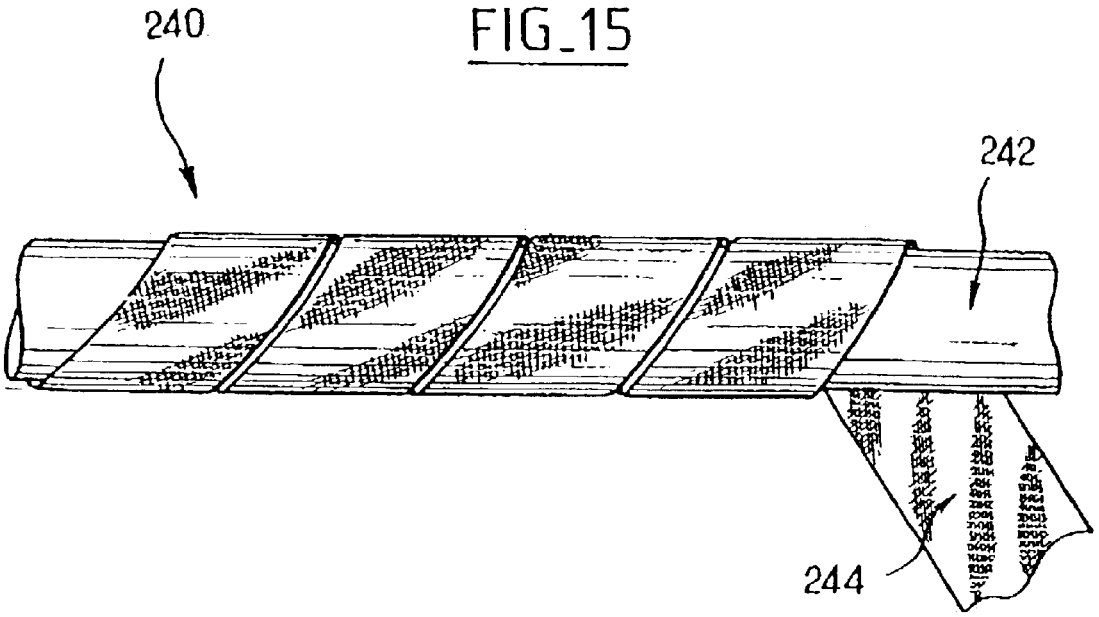
Figure 16:
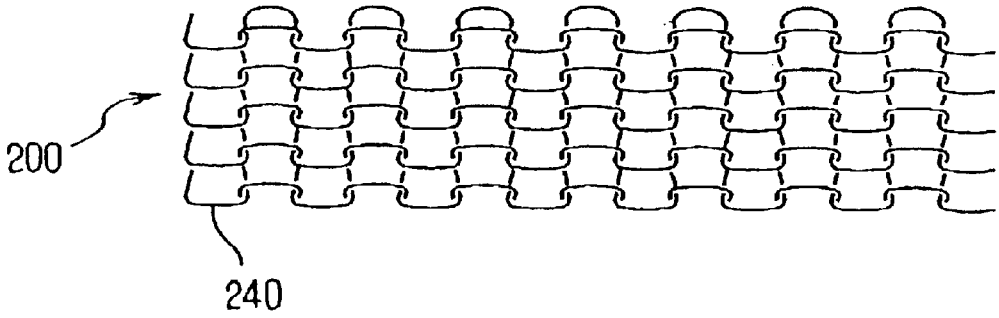
Figure 17:
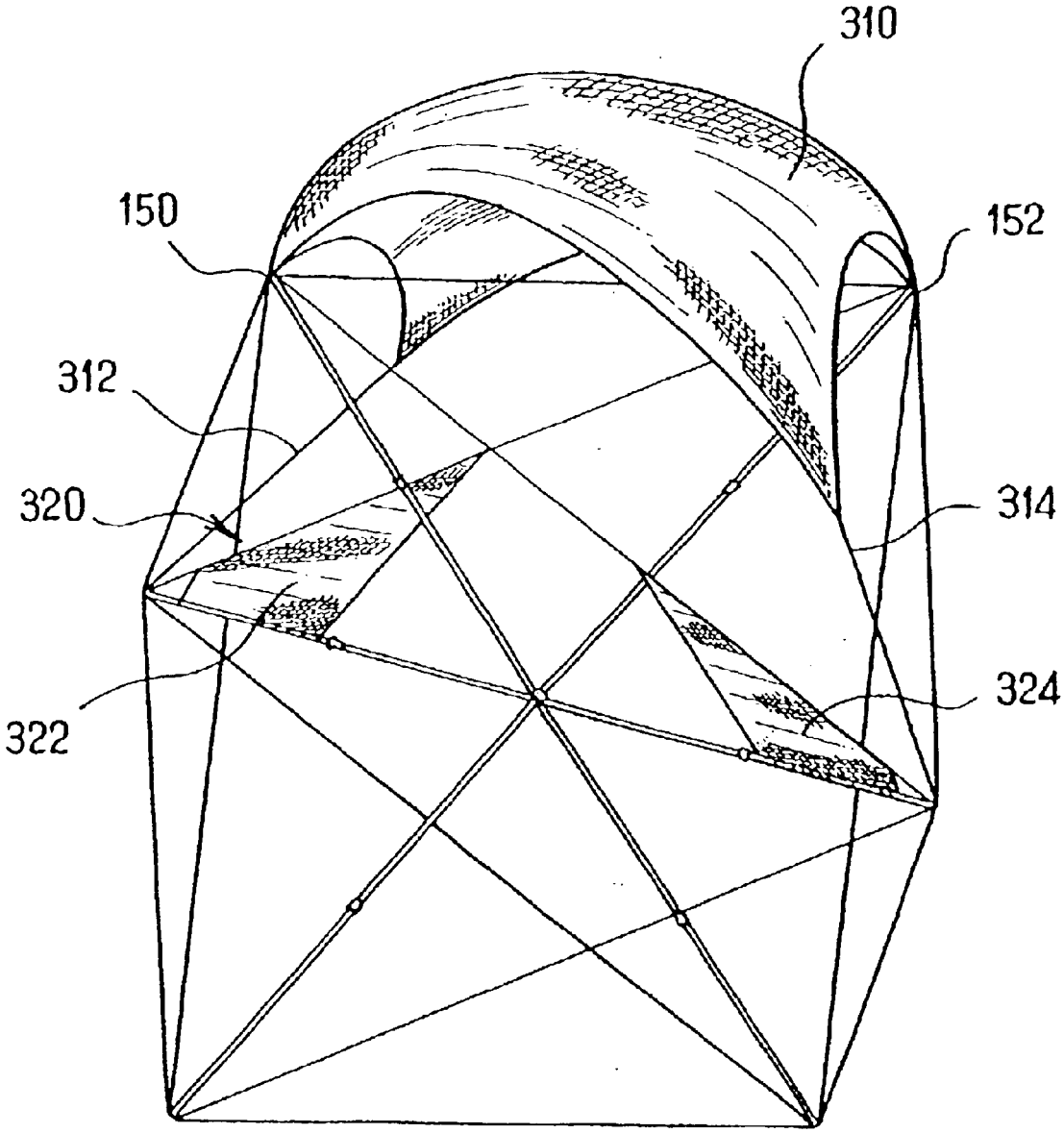

FIGS. 4, 5, and 6 are diagrams showing the device in accordance with the present invention in three successive stages while it is deploying;

FIG. 7 is a graph showing how gas pressure from a pyrotechnical generator for implementing deployment rises as a function of time;

FIG. 8 is a diagram of a preferred arrangement of pyrotechnical means suitable for generating deployment gases in accordance with the invention;

FIGS. 9, 10, 11, and 12 show means for locking a telescopic mast in accordance with the present invention during four successive stages of deployment;

FIG. 13 is a fragmentary view of a cloth element in accordance with the invention at one of its radially outer corners co-operating with an arm and with a sling;

FIG. 14 is a detail view of a cloth in its radially inner corner zone co-operating with two arms close to the central core;

FIG. 15 shows a covered yarn that is preferably used in the context of the invention for making the cloth;

FIG. 16 is a diagram showing the stitches of a knitted cloth in accordance with the invention; and FIG. 17 is a diagram showing the device in accordance with the present invention in its deployed position, and in particular fitted with means for controlling its aerodynamic behavior.

The description begins with the structure of the deployable support frame 100 in accordance with the present invention.

This frame 100 is designed to serve as a support for elements 100 made of reflective cloth. The frame 100 is also adapted to allow the reflector device in accordance with the present invention to deploy quickly and independently, which device is preferably in the general shape of an octahedron. The frame 100 is adapted to guarantee excellent geometrical precision (the faces formed by the elements 200 of cloth are mutually orthogonal), and also good planeness for each panel made up of such elements, so as to guarantee that the reflector is effective.

Essentially, the deployable support frame 100 in accordance with the present invention comprises a central core 110 carrying six arms that, once deployed, are to be positioned so as to be orthogonal in pairs projecting from the central core 110.

Still more precisely, in the preferred embodiment shown in the accompanying figures, the deployable support frame 100 thus comprises a telescopic central mast 120 connected to the core 110, together with four arms 130 hinged to the core 110.

Figure 1:
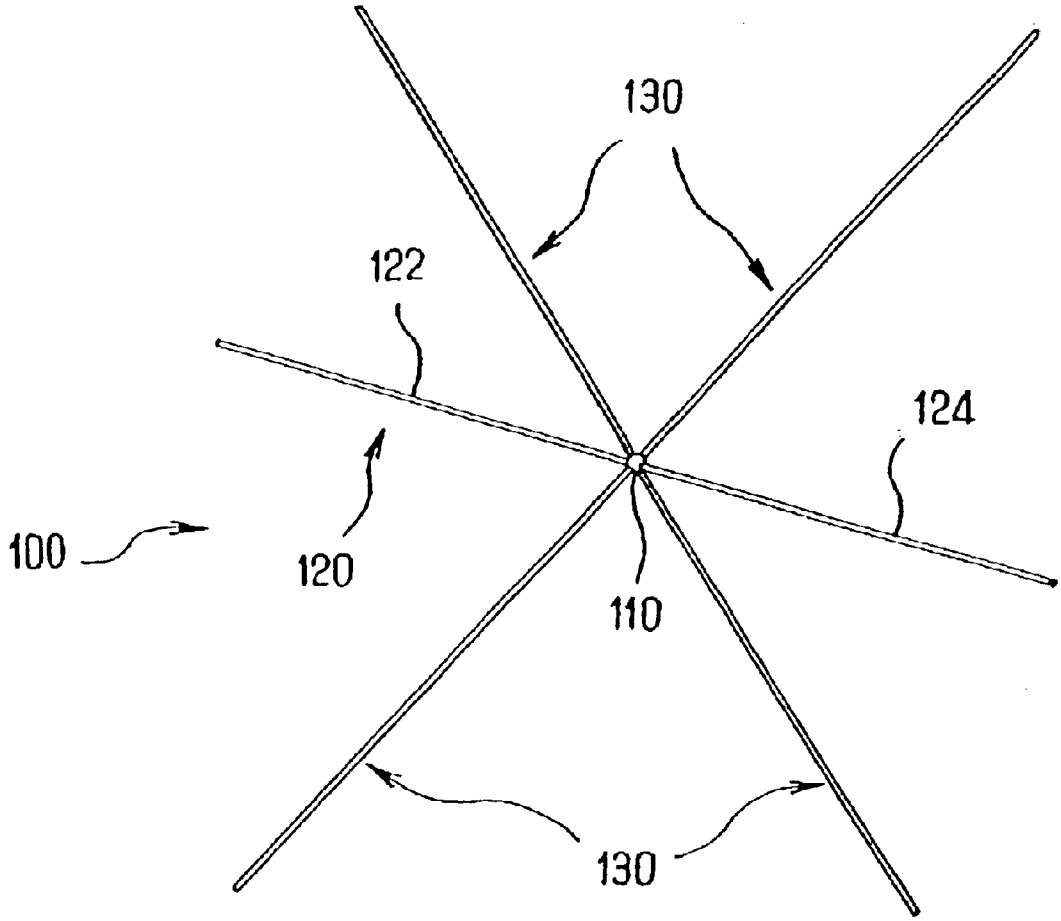
FIG. 1 is a diagrammatic overall perspective view of a device in accordance with the present invention.

Thus, as can be seen in accompanying FIG. 1, when the device in accordance with the present invention is in the deployed position it defines a structure having six arms that are orthogonal in pairs, being distributed in three mutually orthogonal planes each coinciding with four of said arms.

Still more precisely, in the preferred embodiment shown in the accompanying figures, the central mast 120 is made up of two telescopic elements 122 and 124. The element 122 comprises a main outer rod or tube of the mast 120 which slidably receives internally a secondary rod of smaller section constituting the telescopic element 124.

The elements 122 and 124 are rectilinear and of substantially the same length.

Furthermore, the auxiliary arms 130 are also rectilinear and of length substantially equal to the length of the above-mentioned elements 122 and 124.

The element 122 of the telescopic mast 120 has one end fixed to the core 110, via its end through which the element 124 emerges.

The core 110 is made as a piece having a through channel 112.

The channel 112 slidably receives the telescopic element 124 of the mast which is coaxial therewith.

The core 110 also carries on its outer periphery four forks 114 on which the four pivoting arms 130 are respectively hinged about pins 116.

The pins 116 extend transversely to the longitudinal axis of the mast 120 and of the channel 112. The forks 114 are uniformly distributed around the axis of the channel 112, being at 90° C. from one another.

Thus, the pins 116 of the forks 114 extend in a generally peripheral direction around the axis of the channel 112 and the longitudinal axis of the mast 120.

The pins 116 of the forks 114 are parallel and orthogonal in respective pairs.

Each pair of arms defined by the mast 120 and the auxiliary arms 130 carries a cloth element 200 that is of generally triangular shape.

Thus, once deployed, the device in accordance with the present invention defines eight concave corners of a cube, as can be seen in FIG. 17. Thus, the device in accordance with the present invention corresponds to an octahedron.

By way of non-limiting example, the length of each arm 130 and of the elements 122 and 124 of the telescopic mast is about 900 millimeters (mm).

Figure 3:
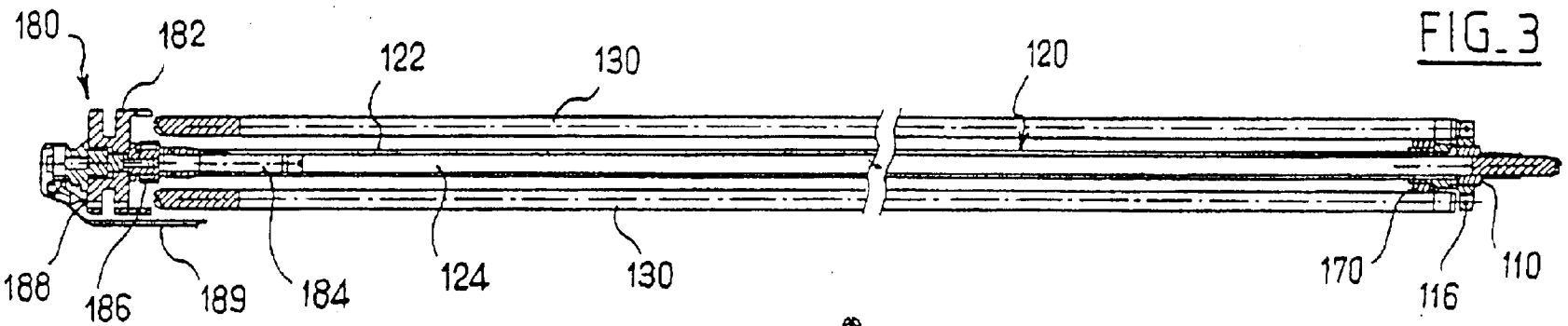
FIG. 3 shows the same support frame in accordance with the present invention, in the folded position.
Figure 2:
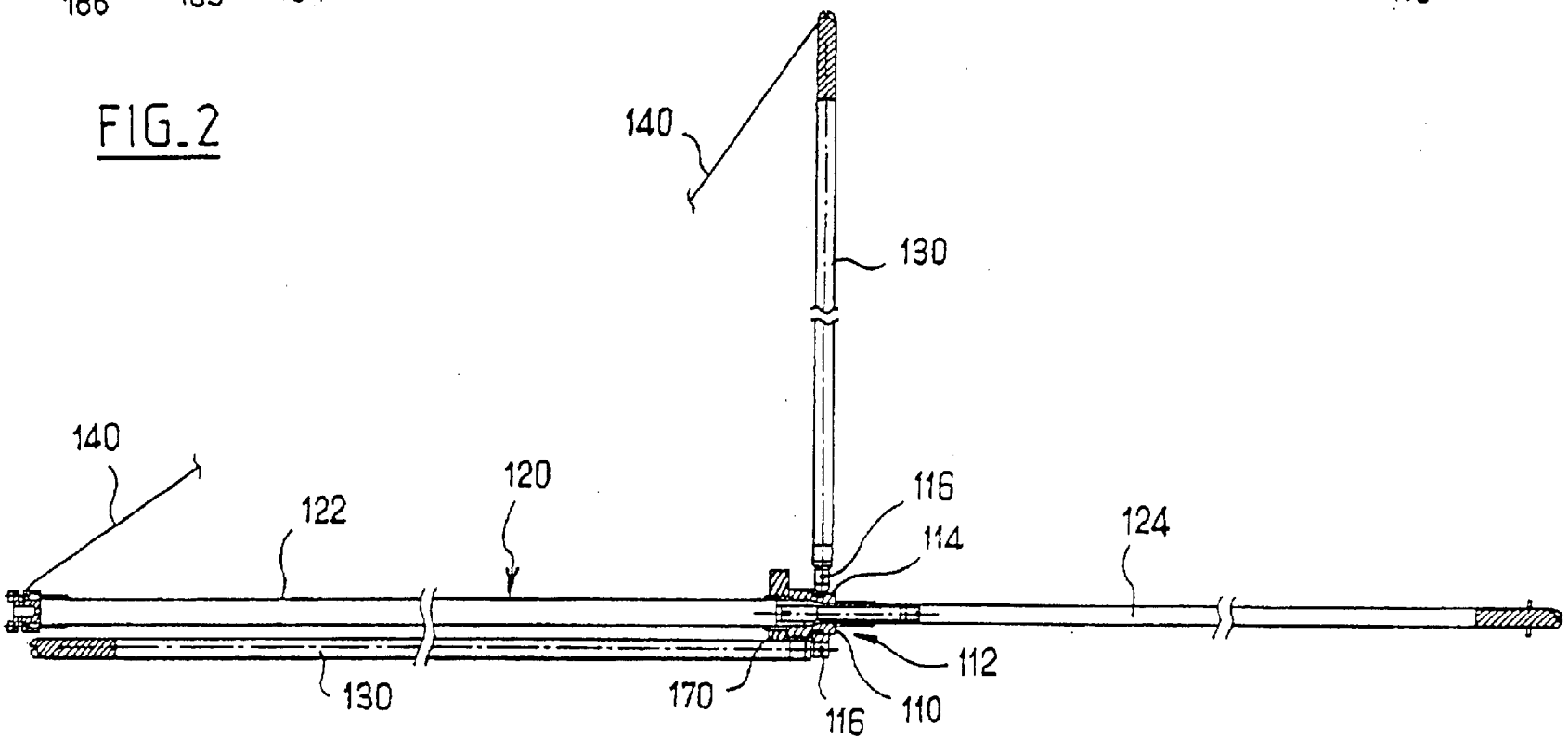
FIG. 2 is a fragmentary view of a support frame in accordance with the present invention, partially deployed.

Furthermore, in the folded state, as shown in FIG. 3, the device in accordance with the present invention occupies a cylindrical volume having a length of about 1 meter (m) with a diameter of about 55 mm.

The device in accordance with the present invention is preferably associated with deployment means comprising a gas generator based on a pyrotechnical material.

For this purpose, a gasket, such as an O-ring 142 is placed between the two telescopic elements 122 and 124. The main element 122 of the mast 120 is also associated with a pyrotechnical type gas generator 180 which delivers into the inside volume of the element 122.

Such a generator 180 may be formed by a conventional structure known as an igniter plug which is fixed to the second end of the element 122, i.e. its end remote from the support core 110.

Since the general structure of a gas generator 180 is known to the person skilled in the art, it is not described in detail below.

The person skilled in the art will understand that such a generator 180 generates gas under pressure inside the element 122 of the telescopic mast. The generated gas thus applied pressure on the element 124 and tends to deploy it telescopically like an actuator or a piston.

Essentially, the generator 180 preferably comprises a body 182 carrying at least one pyrotechnical composition 184 associated with a cap 186 suitable for being initiated by a striker 188, itself associated with a control lever 189.

The use of a pyrotechnical gas generator makes it possible to benefit from an excellent ratio of onboard energy/volume.

As can be seen in the accompanying figures, the gas generator 180 is integrated inside the central telescopic mast 120.

The gas delivered by the combustion is released into the central mast 120 which lengthens (deploying the element 124 relative to the base segment 122) under the effect of pressure (the actuator effect).

In addition, it is the lengthening of the central mast 120 which causes the structure to be deployed by pulling on the peripheral arms 130 by means of the slings 140.

As can be seen in the accompanying figures, a sling 140 is provided between each adjacent pair of vertices of the device, i.e. between the ends of the arms 130 and the ends of the telescopic mast 120.

Thus, each of the six vertices of the device is connected to the four adjacent vertices via a respective sling 140.

The device thus has a total of twelve slings 140.

The slings 140 are preferably made of a material that elongates little such as Kevlar (registered trademark).

The length of each sling 140 is equal to the length between two adjacent vertices of the structure when in the deployed position, such that the slings are tensioned when the structure is in the deployed state and hold the arms 120 and 130 firmly and with precision.

Preferably, in the context of the present invention, the gas generator 180 is adapted to define two distinct successive operating regimes: a slow phase followed by a fast phase.

The initial slow phase enables pressure to rise slowly inside the telescopic mast 120 so as to enable the structure to be deployed without being damaged. Typically, the force during this first stage is a few tens of newtons.

The following fast stage corresponds to tensioning the reflector and it requires a greater level of force, typically about 300 newtons.

The pressure rise is shown diagrammatically in accompanying FIG. 7.

To obtain such operation in the form of two successive sequences, the gas generator 180 may comprise, for example and as shown in FIG. 8, a composition that is packaged in the form of two distinct assemblies 190 and 192.

The first assembly 190 whose combustion provides the slow first stage is formed by a single cylindrical block of compressed material that is packaged in such a manner as to operate at relatively slow speed (it burns like a cigarette).

The second assembly 192 is made up of a plurality of blocks of compressed composition (e.g. five blocks) which composition is characterized by burning fast.

The telescopic mast 120 and the peripheral hinged arms 130 may be made out of any suitable material. They are preferably made of metal or a metal-based composite material.

As mentioned above, the structure is deployed as the auxiliary rod 124 moves by means of the traction then exerted on the pivot arms 130 by the slings 140.

Nevertheless, and preferably, means are provided for assisting deployment of the pivot arms 130, said means being in the form of spring elements 170.

In the embodiment shown in the accompanying figures, these spring elements 170 are interposed between the base element 122 of the telescopic mast 120 and each of the pivot arms 130, respectively.

Still more precisely, in a particular embodiment shown in the accompanying figures, a block of elastomer 170 is provided close to the central support core 110 between the telescopic mast 120 at each of the pivot arms 130.

In the folded position, as shown in FIG. 3, the elastomer blocks 170 are compressed.

Deployment of the device in accordance with the present invention is shown diagrammatically in FIGS. 4, 5, and 6.

In FIG. 4 the device is shown in its folded position, the pivot arms 130 lying along the base element 122 of the telescopic mast 120 and the auxiliary rod 124 being retracted inside the base element 122.

FIG. 5 shows the beginning of the deployment of the structure, with the rod 124 beginning to come out from the base element 122 and with the four arms 130 beginning to pivot because of the traction exerted by the slings 140, with this being assisted by the elastomer springs 170.

Finally, FIG. 6 shows the structure in accordance with the present invention in the deployed state, the four pivot arms 130 then being coplanar in a plane orthogonal to the axis of the central mast 120, and the twelve slings 140 being placed in tensioned positions.

The device in accordance with the present invention preferably further comprises a device for locking the arms 130 in the deployed position.

Such a locking system can be implemented in numerous ways.

The purpose of such a locking device is naturally to preserve geometrical precision.

Such a locking system also serves to overcome the effects of the pressure inside the telescopic mast 120 falling off as the temperature of the gas decreases.

In the context of the present invention, the above-specified locking means are preferably based on a metal retainer ring 160 designed, once the device is in the deployed position, to interfere with grooves 123 and 125 formed respectively in the base element 122 and in the telescopic element 124 of the mast 120.

This causes the telescopic mast 120 to be blocked in both directions.

The structure of such locking means and how it operates are shown in accompanying FIGS. 9 to 12.

In these figures, there can be seen the central support core 110 provided with its forks 114 and the ends of the base element 122 and the telescopic element 124 of the mast 120.

At rest, the metal retainer ring 160 is located in the core 110. At rest, the retainer ring 160 has a diameter that is greater than the outside diameter of the telescopic tube 124. The retainer ring 160 is thus placed in the groove 123 of the base element 122. There is thus no friction between the retainer ring 160 and the tube 124 of the telescopic mast.

Nevertheless, at its end inside the base element 122, the telescopic tube 124 is provided with a cone 126 that flares towards its end. The above-mentioned O-ring 142 is preferable provided on the flared cone 126.

The outside diameter of the cone 126 is greater than the inside diameter at rest of the retainer ring 160.

Thus, during displacement of the telescopic element 124, the cone 126 engages and opens the retainer ring 160. The cone 126 of the telescopic element 124 is provided with the above-mentioned groove 125 in its outer surface.

Figure 11:
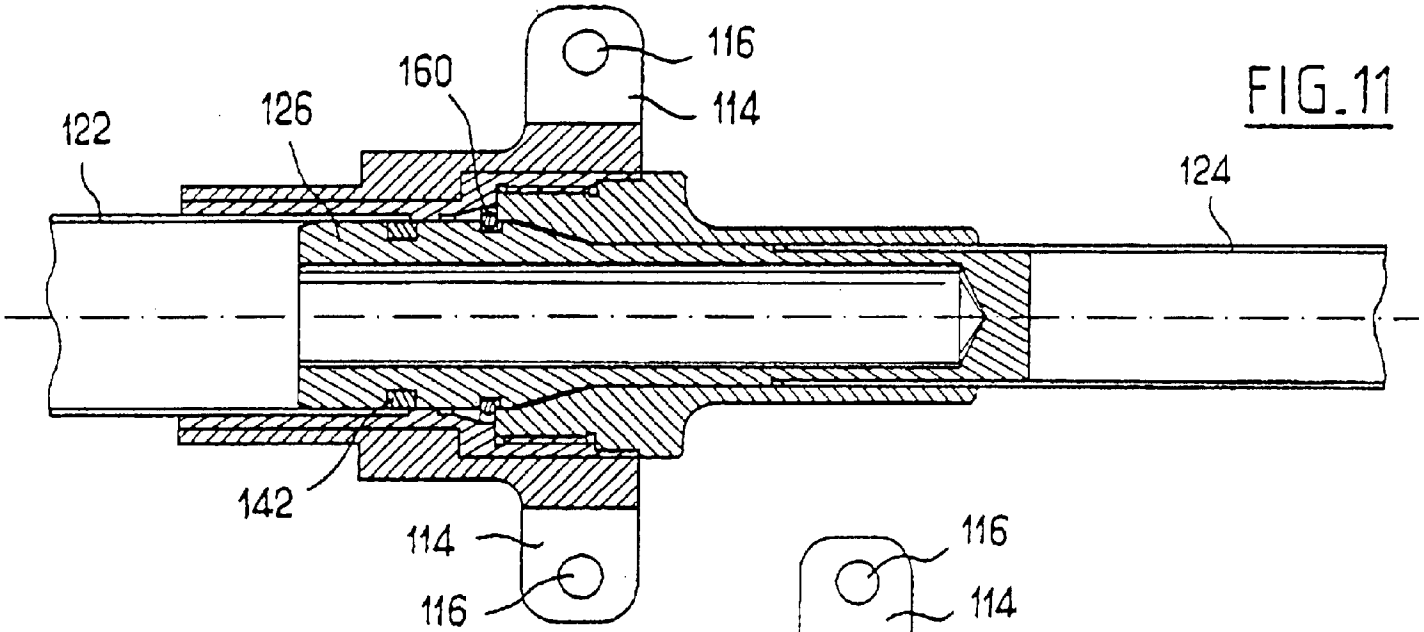
Figure 12:
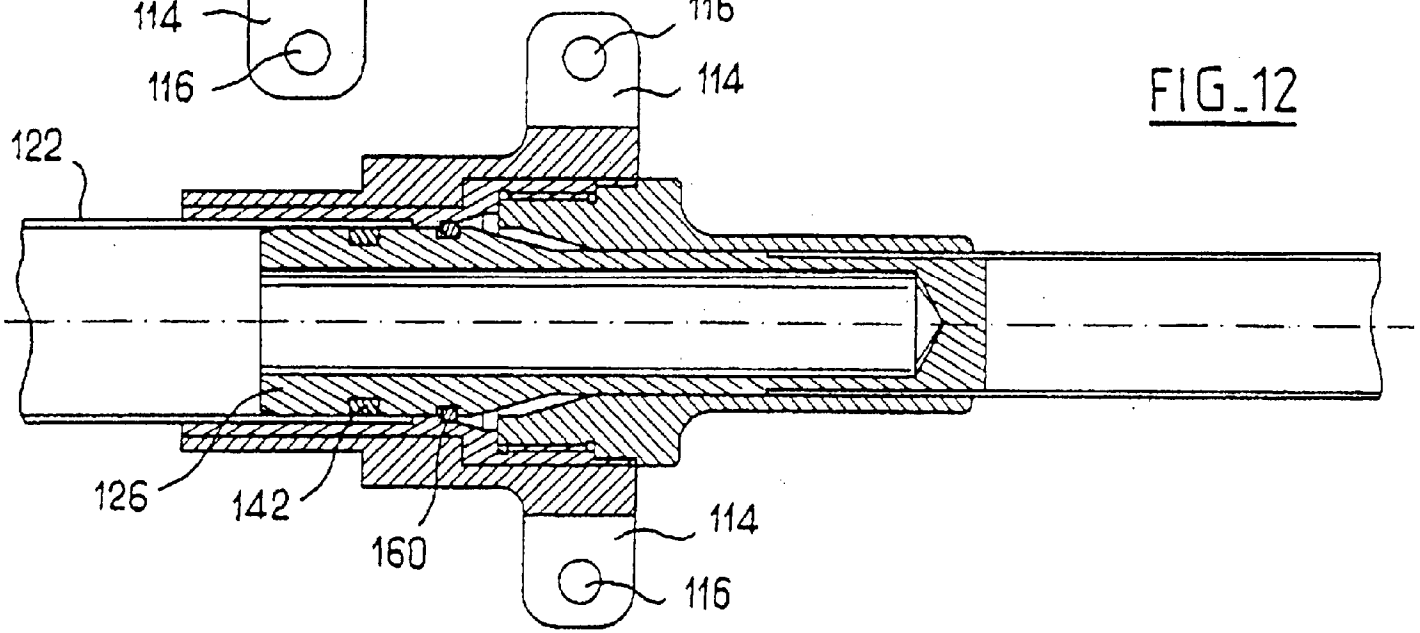

When the groove 125 of the piston 124 comes up to the retainer ring 160, as shown in FIG. 11, the retainer ring closes into the groove 125 under its own elasticity, thus blocking the mast.

The locking device as formed in this way presents, amongst others, the following advantages: small number of parts; locking is reliable and effective; good high temperature performance; no friction while the mast is moving; good aging.

In a variant embodiment in accordance with the present invention, each of the tubes 130, and consequently the base element 122 and the element 124 itself of the mast 120 is telescopic, i.e. each is formed of at least two elements capable of sliding relative to each other along their axis to increase their length.

This variant makes it possible both to have a deployed structure of large size and a storage volume of small size.

As mentioned above, the above-specified deployable support frame 100 is associated with a plurality of reflector-forming cloth elements.

Still more precisely, the support frame 100 carries twelve triangular panels 200 suitable for forming eight concave corners of a cube in an octahedron configuration.

These panels 200 are designed to reflect electromagnetic waves in a particular frequency band.

The panels 200 are fixed together in groups of four on textile hems or sheaths 210 which provide the interface between the structure and its covering by covering the arms 130 of the frame.

The edges of the panels 200 adjacent to the telescopic mast 120 are also provided with a hem or sheath common to four panels. Nevertheless, the hem fitted to the telescopic portion 122 is larger so as to allow the tube to slide.

In the folded position, this hem is gathered onto the folded portion.

The hem placed on the base element 122 of the telescopic mast is preferably made of a material that withstands the high skin temperature that follows operation of the gas generator 180.

As can be seen in FIG. 13, each of the triangular panels 200 is provided at its radially outer free edge with a small hem 220 receiving a respective one of the slings 140. Each sling 140 can slide in the associated hem 220.

During deployment, the gas pressure generated by the gas generator 180 is converted into thrust along the axis of the central mast 120 which is shared amongst the slings 140, thus enabling the reflective pieces of cloth 200 to be tensioned.

FIG. 14 shows the radially inner corner of a panel 200.

Each panel 200 is preferably provided with reinforcement 230 in each of its corners.

Each reflective element 200 is preferably based on a knitted yarn 240.

In the context of the invention, this is preferably a 7-gauge plain stitch knit made using a polyester yarn 242 covered in a nickel foil 244 as shown in FIG. 15 (i.e. a fine strip of nickel 244 is spiral-wound around the polyester yarn 242).

The metric number of the yarn is 22 (22,000 m of yarn weigh 1 kilogram (kg)).

The diameter of the polyester yarn 242 typically lies in the range 200 micrometers ($\mu$m) to 250 $\mu$m.

The density of the cloth typically lies in the range 80 grams per square meter (g/m$^2$) to 85 g/m$^2$.

Furthermore, and preferably, the covering foil 244 is generally oblong in section, e.g. being almost rectangular, so as to provide good electrical contact at each adjacent point between two segments of yarn 240.

This solution is used in the context of the present invention since it makes it possible to have yarn that is highly conductive, to improve the quality of individual yarn-to-yarn contact, while nevertheless using yarn having good mechanical characteristics.

Furthermore, plain stitch knitting is simple to implement and inexpensive in terms of material needed for a given size of stitch.

Naturally, the present invention is not limited to the particular embodiment described above for each triangular panel 200.

For example, the basic polyester yarn 242 could be replaced by any equivalent material, e.g. polyamide.

Furthermore, the covering nickel foil 244 could be replaced by any equivalent material, for example steel or copper plus nickel.

In another variant, each triangular reflector panel 200 may be based on metallized polyester tulle.

Such a panel based on metallized polyester tulle can be based on cotton, silk, thermoplastic material, or an equivalent, arranged in a blocked mesh array, e.g. a generally hexagonal mesh. Metallization can be obtained by depositing nickel, e.g. to a thickness of about 1 $\mu$m. The diameter of the basic yarn is typically about 200 $\mu$m, and the density of the panel about 30 g/m$^2$ to 40 g/m$^2$.

As suggested above, the device in accordance with the present invention preferably has means 300 designed to control the aerodynamic behavior of the reflector while it is in free fall.

More precisely, these means 300 act to control both the orientation and possibly the rotation of the reflector while it is in free fall.

More precisely, in the context of the invention, the means 300 are advantageously designed to control the following:

an equilibrium position on one edge, as shown in FIG. 17 (at least one external edge is horizontal);

a regular given speed of rotation for the reflector about a vertical axis;

good stability about the equilibrium position;

time taken to achieve stabilization as short as possible (overturning stage);

rate of free fall as slow as possible; and drift as small as possible (no aerodynamic lift).

In a variant, the means 300 may be adapted to cause the equilibrium position to be set not on a horizontal edge as shown in FIG. 17, but on having three horizontal edges.

In the context of the invention, it appears to be important to avoid having an equilibrium position on a corner, i.e. on an orientation of the reflector with one of its corners pointing down, i.e. with one of the arms 130 or the mast 120 being vertical.

Various orienting means can be used for this purpose.

In the context of the present invention, the orientation means 300 preferably comprise a dome of cloth 310 forming a parachute. This cloth 310 may be formed, for example, by a cloth square that is of very light weight and very porous, connected to two top peripheral nodes 150 and 152 and to both ends of the central telescopic mast 120, as shown in FIG. 17. In this figure, the cloth 310 is fixed directly to the top nodes 150 and 152. The cloth 310 is also connected to the ends of the telescopic central mast 120 by slings 312 and 314.

Typically the cloth 310 measures 1060 mm×1060 mm and the slings 312 and 314 connecting the cloth 310 to the ends of the central mast 120 are about 500 mm long.

Using a porous material to make the cloth 310 enables lift to be sacrificed to the advantage of drag without thereby harming speed of fall.

Furthermore, as can be seen in FIG. 17, the control means 300 preferably have elements 320 designed to impart rotary motion about a vertical axis while the reflector is falling.

These means 320 are symmetrical about a vertical axis passing through the center of the core 110 and the middle of one of the edges defined by a sling 140.

Still more precisely, and preferably, these means 320 are formed by two small triangular sails 322 and 324 of cloth that is very light weight and non-porous, the sails being disposed on the sloping top panels disposed respectively at the ends of the central mast 120 and symmetrically about the central core 110, i.e. disposed respectively between the two segments 122, 124 of the telescopic mast 120 and the two arms 130 that are coplanar therewith in a vertical plane, extending upwards from the central core 110.

These two small sails that are generally adjacent to vertices of the octahedron serve to impart rotary motion about the above-mentioned vertical axis.

Naturally, the present invention is not limited to the particular embodiments described above but it extends to any variant in the spirit of the invention.

For example, the above-described reflective octahedron may be associated with metallized or metal chaff.

Furthermore, a plurality of octahedra may be associated, 3 to 10, including octahedra of different sizes.

In other variant embodiments, the cloth triangles 322 and 324 for imparting rotation may be associated with or replaced by symmetrical or asymmetrical holes formed in the reflective panels.

The present invention is not limited to being implemented in the form of an octahedron, but it extends to making any polyhedron.

What is claimed is:

1. A device forming an electromagnetic reflector comprising:

a deployable support frame (100) carrying at least one cloth element (200) designed, in the deployed state, to form a reflective surface, the deployable support frame (100) comprising at least one deployable arm (120) that is telescopic; and control means including a pyrotechnical generator (180) suitable to generate gas under pressure into said deployable arm (120) so as to deploy telescopically said deployable arm, said pyrotechnical generator being adapted in an initial stage to define a pressure which rises slowly and subsequently to increase the pressure rise.

2. A device according to claim 1, wherein the cloth (200) is formed by a knitted fabric.

3. A device according to claim 1, further comprising:

means (310, 322, 324) for controlling the orientation and the rotation of the structure.

4. A device according to claim 3, further comprising:

aerodynamic behavior control means (310, 322, 324) suitable for imposing an orientation on the deployable support frame such that it presents at least one external edge that is horizontal.

5. A device according to claim 1, wherein the deployable support frame (100) carries a plurality of cloth elements (200) designed, in combination and in the deployed state, to form reflective polyhedra.

6. A device according to claim 1, wherein the deployable support frame (100) has a central core (110) carrying at least the telescopic deployable arm.

7. A device according to claim 1, wherein the support frame (100) comprises a telescopic mast (120) associated with the central core (110) and a plurality of central pivot arms hinged to the central core (110).

8. A device according to claim 1, wherein the support frame (100) comprises a telescopic mast (120) having a main segment (122) slidably receiving at least one auxiliary segment (124), the device being characterized by the fact that the main segment (122) is fixed to the central core (110) via its open end through which the auxiliary arm (124) emerges.

9. A device according to claim 1, wherein the support frame (100) comprises a telescopic mast (120) and four pivot arms (130).

10. A device according to claim 1, wherein each arm (120, 130) of the support frame (100) is telescopic and is connected to a central core (110).

11. A device according to claim 10, wherein the deployable support frame (100) comprises six telescopic arms.

12. A device according to claim 1, further comprising:

means (170) suitable for urging the pivot arms (130) into an extended position.

13. A device according to claim 12, wherein the means urging the pivot arms (130) comprise slings (140).

14. A device according to claim 12, wherein the means urging the pivot arms (130) comprise elastomer blocks (170).

15. A device according to claim 1, further comprises:

means (160) suitable for locking the telescopic arm (120) in the deployed position.

16. A device according to claim 15, wherein the locking means include a resilient retainer ring (160).

17. A device according to claim 15, wherein one of the elements (124) of the telescopic deployable arm is provided with a cone (126) adapted to extend a retainer ring (160) during deployment of the telescopic deployable arm, such that the retainer ring (160) once expanded interferes with grooves provided respectively in each of the two elements capable of relative telescopic displacement.

18. A device according to claim 1, wherein the electromagnetic reflector defines eight corners of a cube in the form of an octahedron.

19. A device according to claim 1, wherein the cloth (200) is made of 7-gauge plain stitch knit.

20. A device according to claim 1, wherein the cloth (200) is made of metallized polyester tulle.

21. A device according to claim 1, wherein the cloth (200) is made of a thermoplastic yarn, e.g. based on polyester, that is covered in metal, e.g. nickel.

22. A device according to claim 1, wherein the cloth includes a metal covering foil (244) of elongate section.

23. A device according to claim 1, wherein the cloth (200) is mounted on the arms (120, 130) of the deployable support frame (100) via hems (210) formed along the edges of the cloth (200).

24. A device according to claim 1, further comprising:

slings (140) fixed between pairs of vertices of the deployable structure (100).

25. A device according to claim 24, wherein the slings (140) are placed in hems formed at the edges of the pieces of cloth (200).

26. A device according to claim 1, wherein the support frame (100) comprises at least one sling (140) for good deployment of the cloth (200).

27. A device according to claim 26, wherein the sling (140) is disposed along an edge of the piece of cloth (200).

28. A device forming an electromagnetic reflector comprising:

a support frame (100) carrying a plurality of cloth elements (200) designed in combination to form reflective polyhedra; and aerodynamic behavior control means (310, 322,324) suitable for imposing an orientation on the support frame such that it presents at least one external edge that is horizontal.

29. A device according to claim 28, wherein the support frame (100) is deployable.

30. A device according to claim 28, wherein the support frame (100) comprises at least one deployable arm (120) that is telescopic.

31. A device according to claim 29, wherein the deployable support frame (100) has a central core (110) carrying at least the telescopic deployable arm.

32. A device according to claim 28, wherein the support frame (100) comprises a telescopic mast (120) associated with the central core (110) and a plurality of central pivot arms hinged to the central core (110).

33. A device according to claim 28, wherein the support frame (100) comprises a telescopic mast (120) having a main segment (122) slidably receiving at least one auxiliary segment (124), the device being characterized by the fact that the main segment (122) is fixed to the central core (110) via its open end through which the auxiliary arm (124) emerges.

34. A device according to claim 28, further comprising:

means for controlling aerodynamic behavior that are comprised by a support sail (310).

35. A device according to claim 34, wherein the support sail (310) is made of porous cloth.

36. A device according to claim 34, wherein the support sail (310) is secured firstly to two vertices (150, 152) of the deployable support frame (100), and secondly via slings (312, 314) to two ends of a telescopic mast (120).

37. A device according to claim 28, further comprising:

aerodynamic behavior control means comprising symmetrical means (322, 324) suitable for imparting rotation to the structure about a vertical axis.

38. A device according to claim 37, wherein the means for controlling rotation comprise two symmetrical pieces of cloth (322, 324).

39. A device according to claim 37, wherein the means for controlling rotation comprise orifices formed through the pieces of cloth of the device.

40. A device according to claim 38, wherein the two pieces of cloth (322, 324) are fixed between a telescopic mast (120) and the slings (140).

41. A device according to claim 28, further comprising:

means (310, 322, 324) for controlling aerodynamic behavior suitable for imposing an orientation on the deployable support frame such that it presents at least one bottom edge that is horizontal.

42. A device according to claim 28, further comprising:

means (310, 322, 324) for controlling aerodynamic behavior suitable for imparting an orientation to the deployable support structure (100) such that it has three bottom edges in a horizontal plane.

43. A device according to claim 28, further comprising:

control means comprising a pyrotechnical generator (180).

44. A device according to claim 43, wherein the pyrotechnical generator is designed to define two stages: an initial stage in which pressure rises slowly, followed by a stage in which pressure rises more quickly.

45. A device according to claim 43, wherein the pyrotechnical generator comprises two pellets of pyrotechnical compositions (190, 192) presenting different combustion properties suitable for defining two successive stages, an initial stage of slow pressure rise and another stage of faster pressure rise.

46. A device according to claim 42, further comprising:

twelve slings (140).

47. A device forming an electromagnetic reflector comprising:

a deployable support frame (100) carrying at least one cloth element (200) designed, in the deployed state, to form a reflective surface, the deployable support frame (100) comprising at least one deployable arm (120) that is telescopic; and control means including a pyrotechnical generator (180) provided inside said deployable arm (120), 50 as to telescopically deploy said deployable arm (12) when generating gas under pressure.

48. A device according to claim 47, further comprising:

means (310, 322, 324) for controlling the orientation and the rotation of the structure.

49. A device according to claim 47, further comprising:

aerodynamic behavior control means (310, 322, 324) suitable for imposing an orientation on the deployable support frame such that it presents at least one external edge that is horizontal.

50. A device according to claim 47, wherein the deployable support frame (100) carries a plurality of cloth elements (200) designed, in combination and in the deployed state, to form reflective polyhedra.

51. A device according to claim 47, wherein the support frame (100) comprises a telescopic mast (120) having a main segment (122) slidably receiving at least one auxiliary segment (124), the device being characterized by the fact that the main segment (122) is fixed to the central core (110) via its open end through which the auxiliary arm (124) emerges and four pivot arms.

52. A device according to claim 47, further comprising:

slings (170) suitable for urging the pivot arms (130) into an extended position.

53. A device according to claim 47, wherein the electromagnetic reflector defines eight corners of a cube in the form of an octahedron.

54. A device according to claim 47, further comprising:

means for controlling aerodynamic behavior that are comprised by a support sail (310).

55. A device according to claim 54, wherein the fact that the support sail (310) is made of porous cloth.

56. A device according to claim 54, wherein the support sail (310) is secured firstly to two vertices (150, 152) of the deployable support frame (100), and secondly via slings (312, 314) to two ends of a telescopic mast (120).

57. A device according to claim 47, further comprising:

aerodynamic behavior control means comprising symmetrical means (322, 324) suitable for imparting rotation to the structure about a vertical axis.

58. A device according to claim 57, wherein the means for controlling rotation comprise two symmetrical pieces of cloth (322, 324).

59. A device according to claim 57, wherein the means for controlling rotation comprise orifices formed through the pieces of cloth of the device.

60. A device according to claim 58, wherein the two pieces of cloth (322, 324) are fixed between a telescopic mast (120) and the slings (140).

61. A device according to claim 47, further comprising:

means (310, 322, 324) for controlling aerodynamic behavior suitable for imposing an orientation on the deployable support frame such that it presents at least one bottom edge that is horizontal.

62. A device according to claim 47, further comprises:

means (310, 322, 324) for controlling aerodynamic behavior suitable for imparting an orientation to the deployable support structure (100) such that it has three bottom edges in a horizontal plane.

63. A device according to claim 47, wherein the pyrotechnical generator is designed to define two stages: an initial stage in which pressure rises slowly, followed by a stage in which pressure rises more quickly.

64. A device according to claim 47, wherein the pyrotechnical generator comprises two pellets of pyrotechnical compositions (190, 192) presenting different combustion properties suitable for defining two successive stages, an initial stage of slow pressure rise and another stage of faster pressure rise.

* * * * *